US008132984B2

(12) United States Patent
Grahl

(10) Patent No.: US 8,132,984 B2
(45) Date of Patent: Mar. 13, 2012

(54) MULTIPLE PRESET CONCRETE TROWEL STEERING SYSTEM

(75) Inventor: Scott Grahl, St. Cloud, WI (US)

(73) Assignee: Wacker Neuson Production Americas LLC, Menomonee Falls, WI (US)

( * ) Notice: Subject to any disclaimer, the term of this patent is extended or adjusted under 35 U.S.C. 154(b) by 244 days.

(21) Appl. No.: 12/416,738

(22) Filed: Apr. 1, 2009

(65) Prior Publication Data

US 2010/0254763 A1 Oct. 7, 2010

(51) Int. Cl.
*E01C 19/22* (2006.01)
*A01B 69/00* (2006.01)

(52) U.S. Cl. ..... 404/112; 701/42

(58) Field of Classification Search ..... 404/112, 404/114; 701/42
See application file for complete search history.

(56) References Cited

U.S. PATENT DOCUMENTS

| | | | | |
|---|---|---|---|---|
| 4,120,258 | A | 10/1978 | Spurgin | |
| 5,107,424 | A | 4/1992 | Bird et al. | |
| 5,584,598 | A | 12/1996 | Wantanabe et al. | |
| 5,816,740 | A | 10/1998 | Jaszkowiak | |
| 5,890,833 | A | 4/1999 | Allen et al. | |
| 6,053,660 | A | 4/2000 | Allen et al. | |
| 6,069,460 | A | 5/2000 | Grabowski et al. | |
| 6,089,786 | A | 7/2000 | Allen et al. | |
| 6,106,193 | A | 8/2000 | Allen et al. | |
| 6,148,939 | A * | 11/2000 | Brookhart et al. | 180/6.48 |
| 6,367,577 | B2 | 4/2002 | Murata et al. | |
| 6,368,016 | B1 | 4/2002 | Smith et al. | |
| 6,546,889 | B1 | 4/2003 | Jacob et al. | |
| 6,582,153 | B1 | 6/2003 | Allen et al. | |
| 6,871,125 | B2 | 3/2005 | Oshima et al. | |
| 7,232,277 | B2 | 6/2007 | Corbitt | |
| 7,306,070 | B2 | 12/2007 | Kobayashi | |
| 7,322,439 | B2 | 1/2008 | Hara et al. | |
| 2003/0074086 | A1 | 4/2003 | Karbassi | |
| 2010/0196096 | A1 * | 8/2010 | Halonen et al. | 404/84.1 |

FOREIGN PATENT DOCUMENTS

| | | |
|---|---|---|
| DE | 9418169.1 | 1/1995 |
| EP | 1586723 | 10/2005 |

* cited by examiner

*Primary Examiner* — Thomas Will
*Assistant Examiner* — Abigail A Risic
(74) *Attorney, Agent, or Firm* — Boyle Fredrickson, S.C.

(57) ABSTRACT

A self-propelled concrete finishing trowel has a power steering system that facilitates operator selection of a desired steering performance response of the trowel. The power steering system includes a controller that communicates operator steering instructions from one or more joysticks and the powered actuators associated with the driven shafts. A selector allows the operator to select one or more preset steering modes, each of which has a different set of steering response characteristics for a given range of joystick motion.

20 Claims, 5 Drawing Sheets

MULTIPLE PRESET CONCRETE TROWEL STEERING SYSTEM

BACKGROUND OF THE INVENTION

1. Field of the Invention

The invention relates generally to concrete finishing trowels and, more particularly, to riding concrete finishing trowels having power steering systems.

2. Description of the Related Art

A variety of machines are available for smoothing net and partially cured concrete. These machines range from simple hand trowels, to walk-behind trowels, to self-propelled riding trowels. Regardless of the mode of operation of such trowels, the powered trowels generally include one or more rotors that rotate relative to the concrete surface. Riding finishing trowels can generally finish large sections of concrete more rapidly and efficiently than manually pushed or guided hand-held or walk behind finishing trowels.

Riding concrete finishing trowels typically include a frame having a cage that generally encloses two, and sometimes three or more, rotor assemblies. Each rotor assembly includes a driven vertical shaft and a plurality of trowel blades mounted on and extending radially outwardly from the bottom end of the driven shaft. The driven shafts of the rotor assemblies are driven by one or more engines mounted on the frame and typically linked to the driven shafts by gearboxes of the respective rotor assemblies.

The weight of the finishing trowel, including the operator, is transmitted frictionally to the concrete surface by the rotating blades, thereby smoothing the concrete surface. The pitch of individual blades can be altered relative to the driven shafts via operation of a lever and/or linkage system during use of the machine. Such a construction allows the operator to adjust blade pitch during operation of the power trowel. As commonly understood, blade pitch adjustment alters the pressure applied to the surface being finished by the machine by altering the contact surface area of the blades.

The rotor assemblies of riding trowels also can be tilted relative to the vertical axis of the driven shaft for steering purposes. By tilting the rotor assemblies, the operator can utilize the frictional forces imposed on the blades by the concrete surface to propel and steer the vehicle. Generally, the vehicle will travel in a direction perpendicular to the direction of tilt of the rotor assembly. Specifically, tilting the rotor assembly from side-to-side and fore-and-aft steers the vehicle in the forward/reverse and the left/right directions, respectively. It is also commonly understood that, in the case of a riding trowel having two rotor assemblies, the driven shafts of both rotor assemblies should be tiltable side-to-side for forward/reverse steering control, whereas only the driven shaft of one of the rotor assemblies needs to be tilted fore-and-aft for left/right steering control.

Many riding trowels are equipped with steering assemblies that are manually operated. Such systems are disclosed in applicant's co-pending patent application publication no. 2009/0028642 filed on Jan. 29, 2009 and titled "Concrete Trowel Steering System" as well as U.S. Pat. No. 4,046,484 to Holz and U.S. Pat. No. 5,108,220 to Allen et al. Such assemblies typically include two steering control handles mounted adjacent the operator's seat and accessible by the operator's left and right hands, respectively. Each lever is coupled, via a mechanical linkage assembly, to a pivotable gearbox of an associated rotor assembly. The operator steers the vehicle by tilting the levers fore-and-aft and side-to-side, thereby tilting the gearboxes side-to-side and fore-and-aft, respectively.

Manually operated steering control assemblies of the type disclosed in the Holz and Allen et al. patents are relatively difficult to operate because they require the imposition of a significant physical force by the operator both to move the handles to a particular position and to retain them in that position. Although the system disclosed in Patent Application Publication No. 2009/0028642 reduces the physical demands on the operator, such mechanical physical control of riding trowels can become fatiguing over the course of prolonged operation. To address these problems, trowels have been designed that are steered by powered actuators. For instance, applicant's prior U.S. Pat. No. 6,368,016 discloses a trowel that that is steered using electrically powered actuators to tilt the gearboxes. Still other power trowel steering systems are disclosed in U.S. Pat. Nos. 5,890,833, 6,053,660, and 6,592,290 to Allen and U.S. Pat. No. 5,816,740 to Multiquip. Each of the patents discloses a trowel that is steered by hydraulic actuators. Riding power steered finishing machines typically have one or more joysticks that are positioned proximate an operator seat. The joysticks generate instructions that are communicated to electronic or hydraulic actuators whose operation tilts the respective gearboxes to effect the steering operation. The actuators usually are energized proportionally to the direction and extent of joystick movement. Regardless of whether of the particular operating modality, for each joystick position, the actuator will tilt the gearbox a predetermined magnitude. Progressive changes in joystick tilting will commonly result in progressive changes in gearbox tilting. Because the operator input forces are very small, operator fatigue is significantly reduced during operation when compared to operation of traditional, mechanically steered machines.

Regardless if the steering system is electrical, mechanical, hydraulic, or a combination thereof, the response characteristics of the actuators of a riding power steered trowel are typically preset. These values commonly define the sensitivity and responsiveness of the steering system of the trowel to manipulations of the joystick. Typically, these values are factory preset. They set the extent of gearbox tilting for each of a full range of joystick positions. One system, proposed by the assignee and disclosed in European Application No. EP 1,586,723, additionally permits the response characteristics of an electrically steered trowel to be programmed in the field using a personal data assistant (PDA). Programming the trowel's controller requires intricate knowledge of electronic controls and of how to calibrate those controls. As a result, control calibration, adjustment, and/or fault detection functions are commonly performed by very well-trained personnel. Such configurations yield power steering equipped riding finishing trowels whose steering operation is generally fixed or preset after the fluid system is configured or after the controller is programmed. That is, the gearbox is tilted the same, predetermined amount for each joystick position under all operating conditions.

However, operator preference, as well as concrete and weather conditions, can affect the desired responsiveness of the steering system. Most notably, operators prefer a steering that can be "feathered" or have high resolution when maneuvering along the perimeter of a work area or around obstructions in the work area. Hence, they would prefer to operate the joysticks through a relatively large stroke with a relatively small response to maximize steerability. Conversely, when the machine is being operated over long straight stretches in the center of an unobstructed work area, they would prefer that the steering system respond more for given joystick stroke in order to maximize responsiveness. With respect to concrete conditions, the riding trowel becomes more responsive to steering inputs as the surface of the concrete cures. With respect to weather conditions, overcast, shaded, or otherwise protected concrete surfaces generally take longer to cure and are less susceptible to the drying effects of wind and sun, thereby effecting steering performance of the power trowel used for finishing such surfaces. In short, it is desirable for a variety of reasons to be able to adjust the response characteristics of a steering system of a trowel on the fly, i.e., while operating the trowel. Heretofore available power-steered riding trowels did not have this capability.

Accordingly, there is a need for a ride-on concrete finishing trowel having a power steering system that can be switched between two or more preset steering modes in which each steering mode incorporates a distinct steering association.

SUMMARY OF THE INVENTION

A steering system according to one aspect of the invention includes a steering system that can be quickly and conveniently switched between two or more preset steering modes.

Another aspect of the invention is to provide a power concrete finishing trowel that meets the first principal aspect, that is cost-effective to implement, and that is generally simple to operate.

One or more of these aspects are achieved by a power steering system for a power trowel that includes one or more manually manipulated steering command signal generators, such as joysticks. Actuators, configured to tilt at least a portion of the rotor assemblies to steer the trowel, receive instructions from the signal generators via a controller. The controller stores at least two sets or families of response characteristics, each of which is associated with a respective preset steering mode. A selector can be manipulated by the operator to select one of the steering modes. The selector may comprise a switch that can be actuated by the operator while steering the trowel. Such a configuration allows the operator to select a set of steering responses that best suits prevailing operating conditions and/or his or her preferences.

Another aspect of the invention resides in a method of controlling operation of a power steered riding rotary trowel that includes selecting between at least two preset steering modes. The selection preferably can be made by a seated operator while the trowel is traveling.

These and other aspects, advantages, and features of the invention will become apparent to those skilled in the art from the detailed description and the accompanying drawings. It should be understood, however, that the detailed description and accompanying drawings, while indicating preferred embodiments of the present invention, are given by way of illustration and not of limitation. Many changes and modifications may be made within the scope of the present invention without departing from the spirit thereof. It is hereby disclosed that the invention include all such modifications.

BRIEF DESCRIPTION OF THE DRAWINGS

Preferred exemplary embodiments of the invention are illustrated in the accompanying drawings in which like reference numerals represent like parts throughout, and in which.

DETAILED DESCRIPTION OF THE PREFERRED EMBODIMENTS

Figure 1:
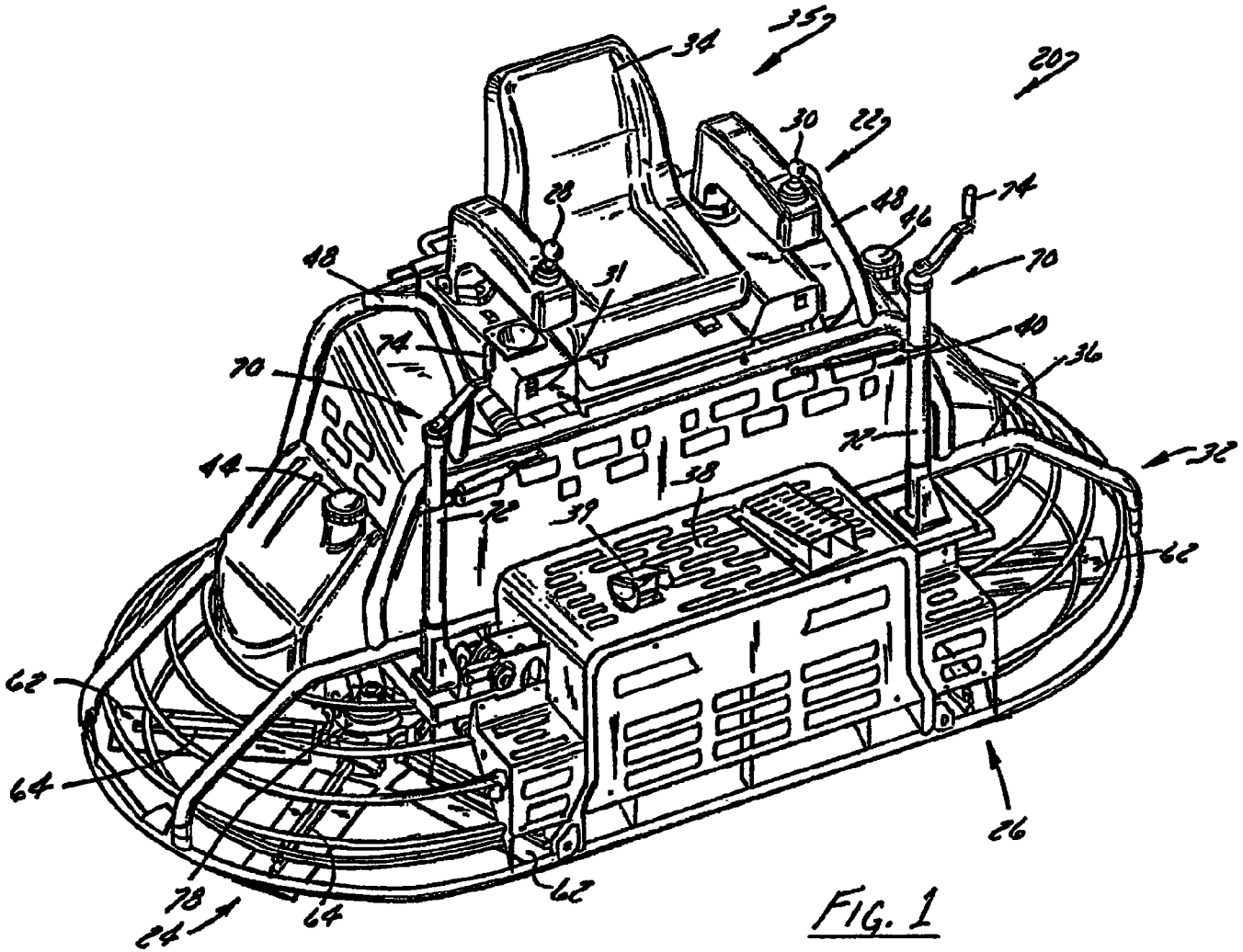
FIG. 1 is a front perspective view of a riding power trowel equipped with a power steering system according to a preferred embodiment the present invention.
Figure 2:
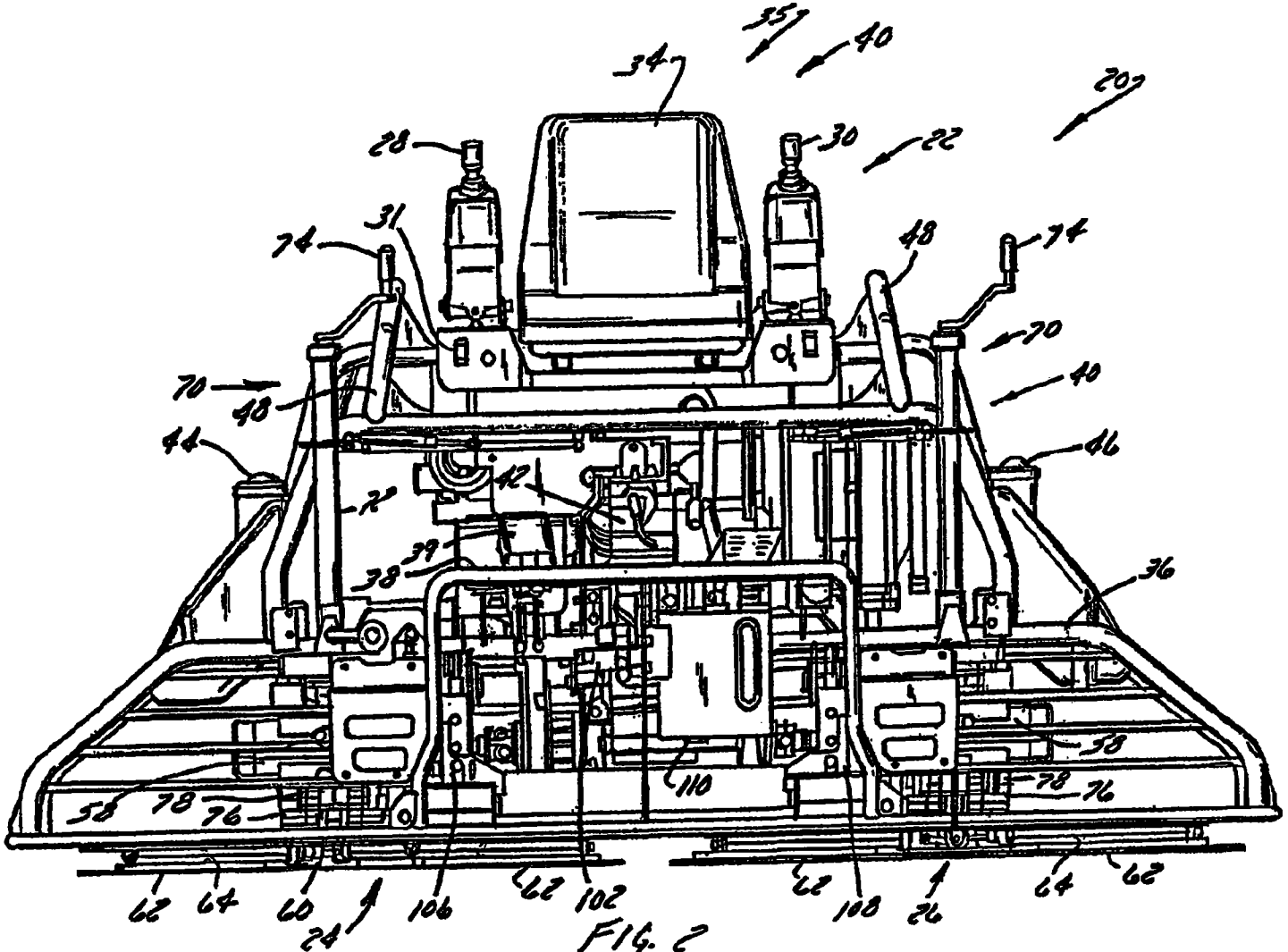
FIG. 2 is front elevation view of the riding trowel shown in FIG. 1 with a portion of the front frame removed to expose portions of the power steering system.

FIGS. 1 and 2 show a self-propelled riding concrete finishing trowel 20 equipped with a steering system 22 according to the present invention. Steering system 22 steers machine 20 by tilting at least the driven shafts of the rotor assemblies 24, 26 of machine 20. Steering system 22 includes one, and preferably two, manually manipulated steering command signal generators. The steering command signal generators comprise joysticks 28 and 30 in the illustrated embodiment but could conceivably take the form of levers or other devices. The joysticks 28, 30 are positioned proximate an area to be occupied by an operator of finishing trowel 20. Steering system 22 also includes a selector 31 (FIG. 1) that can be operated to alter the responsiveness of trowel 20 to steering input signals associated with movement of joysticks 28, 30. The selector may comprise a toggle-switch, a push-button switch, a dial, or any other manually manipulatable device movable between two or more discreet positions to choose between a number of available preset steering modes. The operation of selector 31 of this embodiment and the characteristics of exemplary steering modes selected by its operation are described further below with reference to FIGS. 3-5

Figure 3:
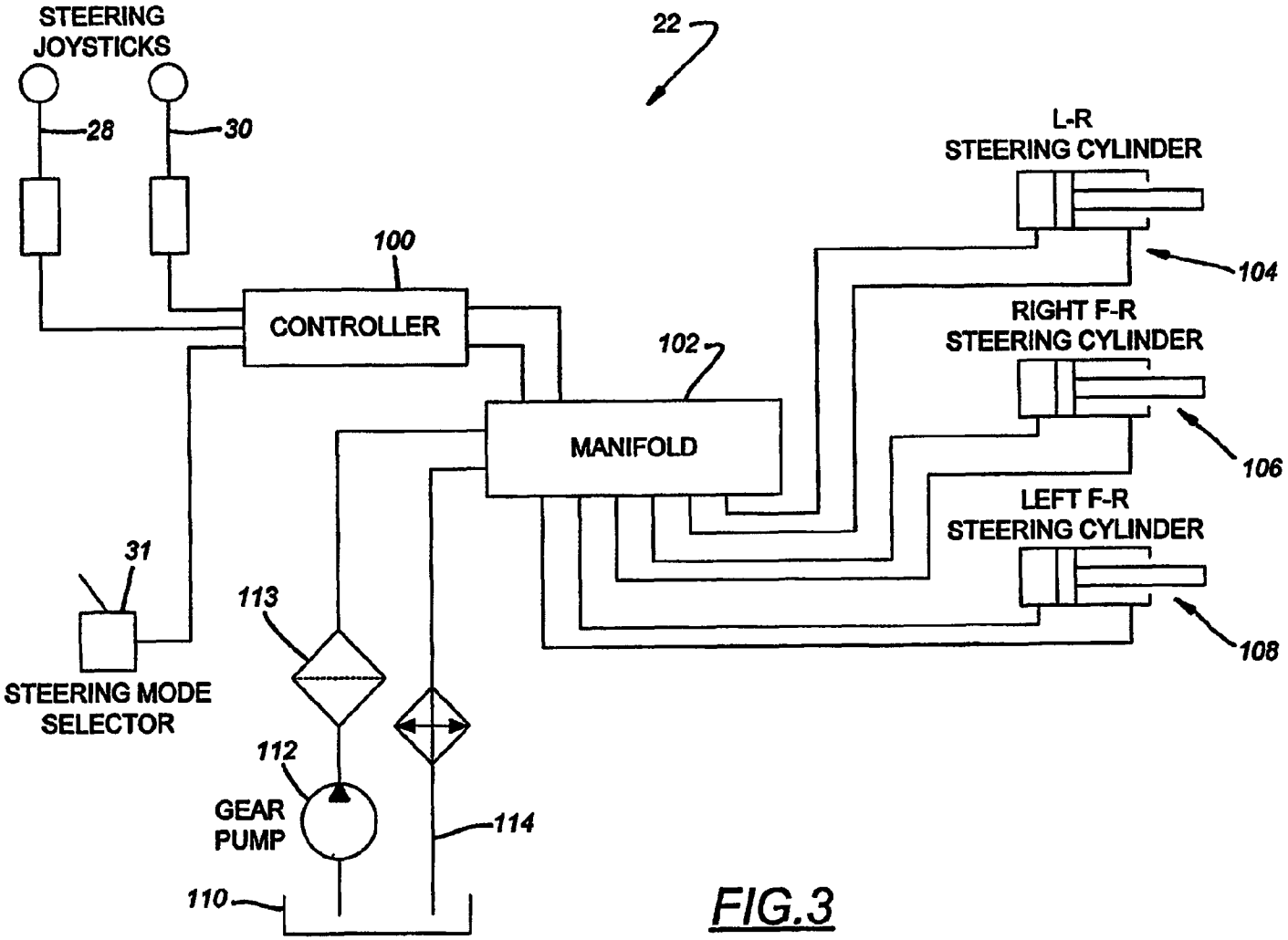
FIG. 3 is a schematic representation of the power steering system of the riding power trowel show in FIG. 1.

Still referring to FIGS. 1-3, as is commonly understood with respect to riding finishing trowels, operator area 35 includes a seat 34 that can be flanked by a pair of arms or arm rests 33 so that an operator is generally centrally positioned between or flanked by joysticks 28, 30. Preferably, joysticks 28, 30 are accessible by an operator positioned in a seat 34. Seat 34 is supported by a generally rigid metallic frame or frame assembly 36 of trowel 20 a platform or pedestal 40. A deck 38 for supporting the operator's feet is located in front of pedestal 40. A shroud or cage 32 is attached to frame assembly 36 and extends in an outward direction relative to operator area 35. Preferably, cage 32 extends at least slightly beyond a rotational footprint associated with operation of rotor assemblies 24, 26. Cage 32 prevents or reduces the incidence of unintended impacts or contacts of rotor assemblies 24, 26 with other devices and structures associated with operation of trowel 20. The rotor assemblies 24 and 26 rotate towards the operator, or counterclockwise and clockwise, respectively, to perform a finishing operation. Cage 32 is positioned at the outer perimeter of machine 20 and extends downwardly from frame 36 to the vicinity of the surface to be finished. A fuel tank 44 is disposed adjacent the right side of pedestal 40, and a water retardant tank 46 is disposed on the left side of pedestal 40. A lift cage assembly 48, best seen in FIG. 1, is attached to the upper surface of the frame 36 beneath pedestal 40 and seat 34.

Referring to FIGS. 1, 2, and 3, each rotor assembly 24, 26 includes a gearbox 58, a driven shaft 60 extending downwardly from the gearbox 58, and a plurality of circumferentially-spaced blades 62 supported on the driven shaft 60 via radial support arms 64. Blades 62 extend radially outwardly from the bottom end of the driven shaft 60 so as to rest on the concrete surface. During operation, blades 62 support the entire combined weight of the operator and trowel 20. Each gearbox 58 is mounted within frame 36 so as to be tiltable relative to frame 36 for reasons detailed below.

The pitch of the blades 62 relative to the plane of operation of each of the right and left rotor assemblies 24 and 26 can be individually adjusted by a dedicated blade pitch adjustment assembly 70. Each blade pitch adjustment assembly 70 includes a generally vertical post 72 and a crank 74 which is mounted on top of the post 72. Each crank 74 can be rotated by an operator positioned in seat 34 to vary the pitch of the trowel blades 62. In the typical arrangement, a thrust collar 76 cooperates with a yoke 78 that is movable to force the thrust collar 76 into a position pivoting trowel blades 62 about an axis that extends in a perpendicular direction relative to the axis of the driven shaft 60. The pitch of blades 62 is often varied as the material being finished sets and becomes more resistant to being worked by the blades.

Both rotor assemblies 24 and 26, as well as other powered components of the finishing trowel 20, are driven by a power source such as internal combustion engine 42 mounted under operator's seat 34 as seen in FIG. 2. The size of engine 42 will vary with the size of the machine 20 and the number of rotor assemblies powered by the engine. The illustrated two-rotor 48" machine typically will employ an engine of about 35 hp. Rotor assemblies 24 and 26 are connected to engine 42 and can be tilted for steering purposes via steering system 22 (FIG. 3). The speed of the engine and, accordingly, the rotational speed of the rotor assemblies 24 and 26, can be controlled using an accelerator pedal 39 supported by deck 38.

As is typical of riding concrete finishing trowels of this type, trowel 20 is steered by tilting a portion or all of each of the rotor assemblies 24 and 26 so that the rotation of the blades 62 generates horizontal forces that propel machine 20. The steering direction is generally perpendicular to the direction of rotor assembly tilt. Hence, side-to-side and fore-and-aft rotor assembly tilting cause machine 20 to move forward/reverse and left/right, respectively. The most expeditious way to effect the tilting required for steering control is by tilting the entire rotor assemblies 24 and 26, including the respective gearboxes 58. The discussion that follows therefore will describe a preferred embodiment in which the entire gearboxes 58 tilt, it being understood that the invention is equally applicable to systems in which other components or only portions of the rotor assemblies 24 and 26 are tilted for steering control.

More specifically, the machine 20 is steered to move forward by tilting the gearboxes 58 laterally relative to the intended direction of travel to increase the pressure on the inner blades of each rotor assembly 24, 26. Conversely, trowel 20 is propelled in a backward or reverse direction by tilting the gearboxes 58 laterally to increase the pressure on the outer blades of each rotor assembly 24, 26. Crab or side-to-side steering requires tilting of only one gearbox, with forward tilting of right rotor assembly 24 increasing the pressure on the front blades of the rotor assembly 24 to steer the machine 20 to the right. Similarly, rearward tilting of rotor assembly 24 increases the pressure on the back blades of the rotor assembly 24 thereby steering machine 20 to the left.

Steering system 22 tilts the gearboxes 58 of the right and left rotor assemblies 24, 26 in response to operator manipulation of joysticks 28, 30. As shown schematically in FIG. 3, joysticks 28, 30 and selector 31 of steering system 22 are constructed to receive operator inputs and are connected to a controller 100. Controller 100 is connected to one or more powered actuators 104, 106, 108 either directly or indirectly via an intermediate routing or distribution device such as a manifold 102. Although it is conceivable that multi-axial actuators and/or complex linkages could be employed to limit the number of actuators to less than three, the most practical system currently known to the inventor has three actuators 104, 106, 108. Operation of actuator 104 effectuates left and right steering operations by fore and aft tilting of rotor assembly 24, whereas actuators 106, 108 effectuate forward and reverse steering and turning by side-to-side tilting of the respective rotor assemblies 24 and 26.

The steering system 22 could be electrically powered, in which case the actuators 104, 106, 108 are electrically powered actuators such as electric screw jack actuators as described in Applicant's prior U.S. Pat. No. 6,368,016, the subject matter of which is hereby incorporated by reference in its entirety. However, the steering system of the illustrated embodiment is hydraulically powered, and the actuators 104, 106, and 108 are hydraulic actuators in the form of double-acting hydraulic cylinders. Fluid flow to and from the hydraulic cylinders is controlled by a valve manifold 102 the individual valves of which are controlled electrically using signals from the controller 100. The hydraulic steering system 22 also includes an unpressurized reservoir 110 that is in fluid communication with a pump 112 and a fluid return 114. Pump 112 draws fluid from the reservoir 110 and delivers pressurized hydraulic fluid to manifold 102 via a filter 113. Instructions, received from controller 100 in response to manipulation of joysticks 28, 30, are used to control valves in the manifold 102 to control fluid flow to and from the double acting hydraulic cylinders forming the actuators 104, 106, 108 to effectuate the desired tilting movement of the respective rotor assembly 24, 26.

The manifold 102 of the presently preferred embodiment includes a plurality of electronically actuated pressure metering valves that can be controlled to vary the pressure on each side of each steering cylinder 104, 106, and 108 between 0 and a maximum of, e.g., 1,000 psi. Six valves are provided in this embodiment. Each has a control or inlet/outlet port coupled to the associated cylinder port, an inlet port coupled to the pump 112, and an outlet port coupled to the reservoir 110. Each valve is responsive to signals from the controller 100 to maintain a pressure in the controlled hydraulic cylinder port that is determined to achieve the commanded response for a given joystick position for a selected steering mode. A proportional pressure reducing valve that acts as an inherently hydraulic closed loop pressure metering unit to achieve a desired pressure at its controlled port is preferred. The "hydraulic closed loop" functionality emulates the electronic closed loop control with a load sensor in an electrically steered trowel. Suitable valves are commercially available, e.g., from Thomas Magnete USA, specifically the PPCD 06 series.

Although steering system 22 is shown as what is commonly understood as an electric over hydraulic or electro-hydraulic system, it should be appreciated from the above discussion that controller 100 could be otherwise connected to electric actuators 104, 106, 108 so as to provide a fully electronic steering system. It is further envisioned that those power trowels having mechanical steering linkages could be adapted for power steering operations via integration of an electric or hydraulic actuator between the respective gearbox and the corresponding steering handle. Such a configuration would also allow replacement of the mechanical steering handle with an electronic joystick.

Figure 4:
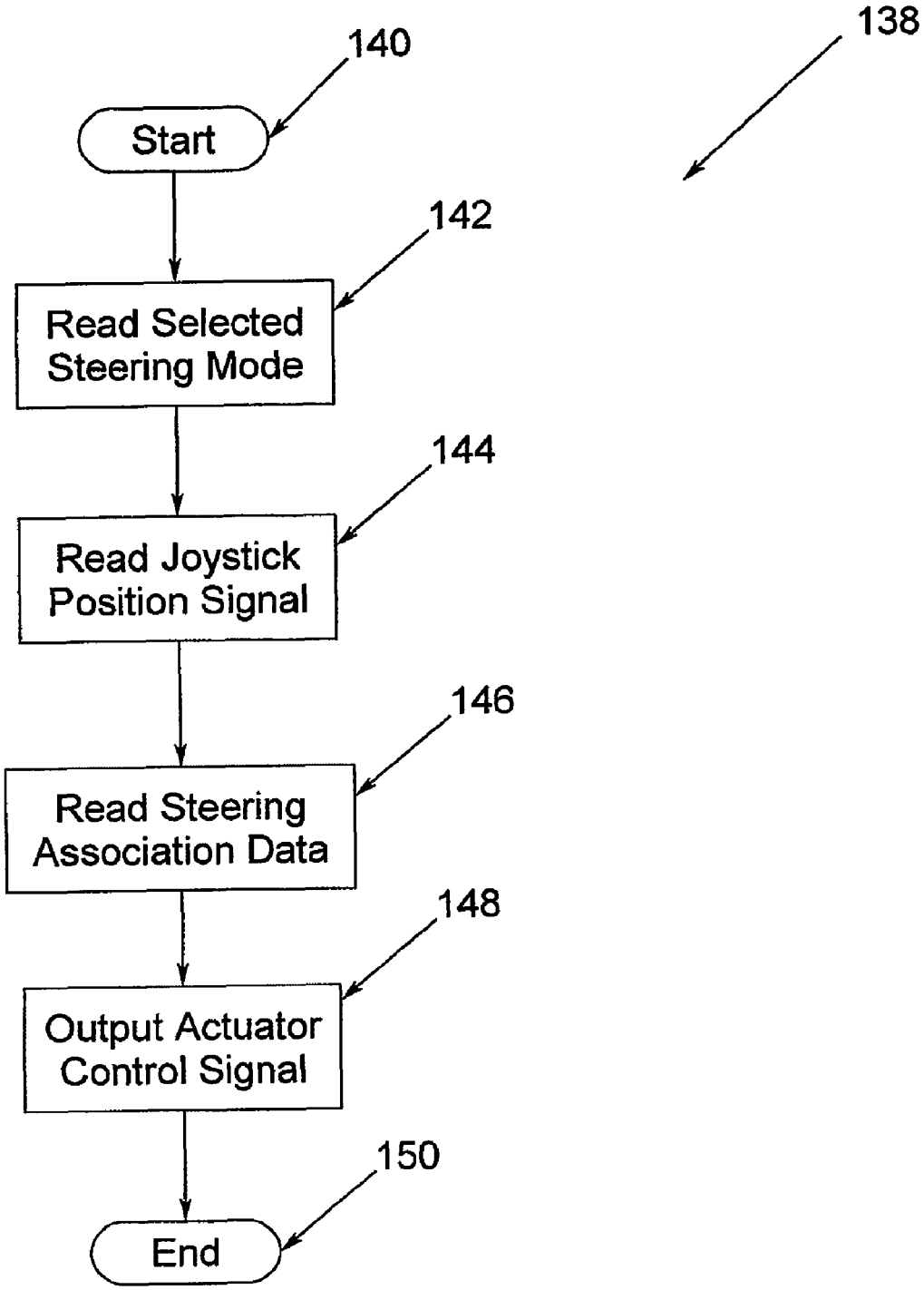
FIG. 4 is a flow chart that shows an exemplary embodiment for operation of the power steering system shown in FIG. 3.

Still referring to FIGS. 1, 3, and 4, in addition to the steering instructions received from joysticks 28, 30, controller 100 is also configured to receive a steering mode selection signal from selector 31. Selector 31 of this embodiment comprises a toggle switch mounted in a location that is easily accessible by a seated operator when operating the trowel. It is more preferably located in the vicinity of or even on the base of one of the joysticks, such as beneath the armrest bearing the joystick 28.

Referring to the flowchart of FIG. 4, controller 100 implements a procedure 138 on a full-time, full-range basis during operation of the trowel that senses and responds to steering commands. The memory of controller 100 has a number of sensitivity association maps stored therein that are each associated with a respective steering mode input from selector 31. As should be apparent from the above, each map identifies, for each steering mode that is selectable, a family of output signals for the control valves of manifold 102 that includes signals for each of a full range of possible positions of the joysticks 28 and 30. The stored output signals for each steering mode are precalibrated to obtain the desired gearbox tilting response under the prevailing joystick displacements. Each map may be pre-calibrated and stored in the memory of controller 100 in the factory or may be at least partially calibrated and stored in the memory of the controller 100 by a technician in the field using an electronic user interface such as a PDA as described in EP 1,586,723, described above and incorporated herein by reference. For a system having two steering modes, the memory will have two maps stored therein, one for each steering mode.

The procedure 138 proceeds from Start in Block 140 to Block 142, where controller 100 reads the steering mode that is derived from the detected position of the steering mode selector 31. Having received the selected steering mode 142, the position or displacement signals that serve as the steering command signals are received from each of the joysticks 28, 30 and read at Block 144. The procedure 138 then proceeds to Block 146, where the controller 100 consults the pre-stored map and reads the steering association data reflecting the desired response associated with the prevailing joystick signal positions in the selected mode. It then generates appropriate actuator control signals and transmits them to the valves of manifold 102 in Block 148. Each of the valves responds to these signals by metering the pressure in the associated hydraulic cylinder port to a level determined to achieve the desired tilting force applied to the gearboxes 58 by the actuators 104, 106, 108. The procedure 138 then proceeds to End in block 150. Understandably, rather than associating joystick translation to a respective tilting force, it is appreciated that joystick translation could alternatively be associated with other information such as actuator stroke and/or rotor tilting. In addition, other values and/or other open loop or closed loop control schemes could be used to control the actuators.

Figure 5:
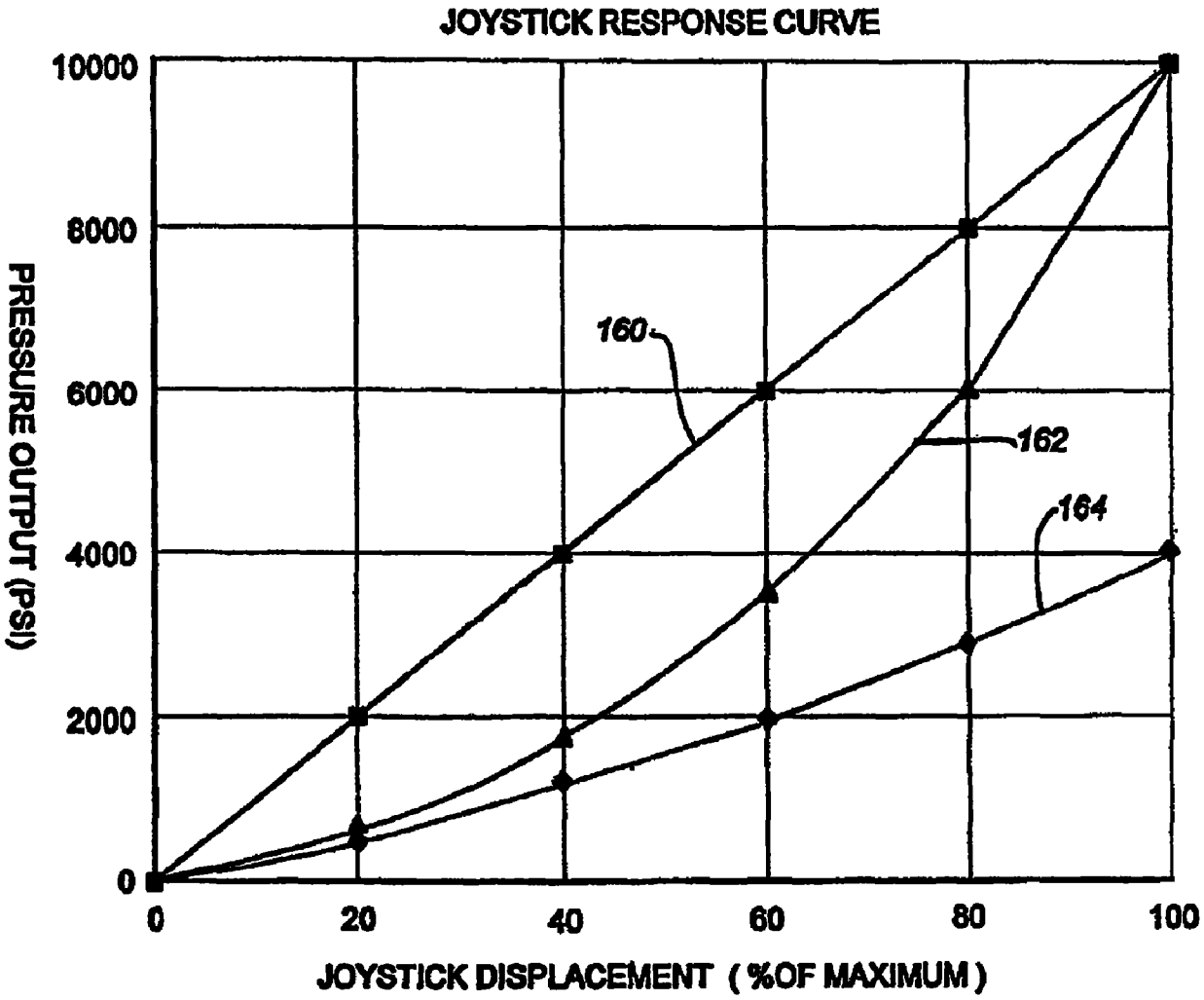
FIG. 5 is a graph showing exemplary steering response characteristics that can be attained with the power steering system shown in FIG. 3.

As mentioned above, each steering mode associates a given range of movement of a joystick 28, 30 with different responses in actuators 104, 106, 108. Said in another way, in each steering mode, steering system 22 provides a different actuator response curve for the same range of joystick translation. Sample response curves 160, 162, and 164 in FIG. 5 plot two different steering response characteristics that can be achieved in two different steering modes. Data required to generate each of these curves may be stored in the memory of controller 100, such as in the form of a map. One mode may be a default mode selected by a default or "home" position of the selector 31.

Referring to FIG. 5, the curves 160, 162, 164 plot hydraulic pressure as delivered by the valves for the actuators 104, 106, and 108 for two exemplary steering modes selectable in accordance with the present invention. The curve 160 illustrates the response characteristics or association for a first or "high responsiveness" mode, and the curves 162 and 164 collectively illustrate the response characteristics or association for a second or "high resolution" mode. In the first mode reflected by curve 160, the pressure delivered by the valves for all three actuators 104, 106, and 108 varies proportionally with joystick stroke through a full range of joystick motion, resulting in a proportional sensitivity of gearbox tilting force to joystick movement throughout the range of joystick movement. The slope of the curve 160 is also relatively steep. Hence, for each incremental movement of either joystick 28, 30 in a given direction, gearbox tilt in any direction increases proportionally through a relatively large increment.

Curve 162 plots the response of the valves for the actuators 106 and 108 in response to fore and aft movement of the joysticks 28 and 30 for forward/reverse propulsion and turning in the second mode. Curve 164 plots the response of the valves for the actuator 104 in response to side-to-side movement of the joystick 28 for side to side steering in the second mode. Both curves 162 and 164 are preferably non-linear, reflecting lower sensitivity and resulting higher steering resolution at smaller joystick strokes and higher sensitivity and resulting lower steering resolution at higher strokes. As the "droops" in the shape of curve 162 and 164 increase, the pressure response of the associated valves decreases through most of the range of joystick movement when compared to the linear response curve 160, converging back to full pressure at full joystick movement, if necessary. (The reduced average magnitude and slope of curve 164 reflects the fact that, due to the geometry and dynamics of trowel operation, the forces and associated hydraulic cylinder pressure required for side-to-side steering are less than those required for fore and aft steering). This mode might be desired by an operator desiring "fine" steering, such as when steering the machine along the edge of a work area or maneuvering around a post or other obstruction. The first steering mode reflected by the linear response of curve 160, on the other hand, might be desired when operating along long passes with relatively little steering and/or when working in sluggish conditions such as initial panning on wet concrete.

The modes illustrated graphically by FIG. 5 are but two of many modes that can be set by storing maps indicative of desired steering response curves in the memory of controller 100. Additional modes that could be stored in the controller 100 and implemented by operation of selector 31 could include separate modes for forward and reverse travel and/or separate modes for side-to-side and forward/reverse steering. Furthermore, the "droops" in the shape of curves 162, 164 could be altered to have other shapes, such as for instance a generally "humped" shape, where a more responsive intermediary joystick travel steering response is preferred.

Hence, the inventive system provides a power steered riding finishing machine whose steering performance can be changed between a number of different preset steering modes by a seated operator while the trowel is traveling. Each mode may itself be separately adjustable at the factory or in the field by suitably programming the controller. The power steering system allows the finishing trowel to be individually configured as a function of the conditions and operator preferences associated with any given finishing project.

Although the best mode contemplated by the inventors of carrying out the present invention is disclosed above, practice of the present invention is not limited thereto. It will be manifest that various additions, modifications and rearrangements of the features of the present invention may be made without deviating from the spirit and scope of the underlying inventive concept. The scope of still other changes to the described embodiments that fall within the present invention but that are not specifically discussed above will become apparent from the appended claims and other attachments.

It is appreciated that many changes and modifications could be made to the invention without departing from the spirit thereof. Some of these changes, such as its applicability to riding concrete finishing trowels having other than two rotors and even to other self-propelled powered finishing trowels, are discussed above. Other changes will become apparent from the appended claims. It is intended that all such changes and/or modifications be incorporated in the appending claims.

What is claimed is:

1. A powered rotary trowel comprising:

a frame that supports an engine and an operator;

at least one rotor assembly that is driven by the engine; and a power steering system that includes:

a manually manipulated steering command signal generator;

an actuator configured to tilt at least a portion of the rotor assembly to steer the trowel;

a control system that supplies power to the actuator, the control system being switchable by the operator to select one of a plurality of preset steering modes each of which associates a different set of steering responses to a range of steering command signal generator actuation;

a mode selector operable by the operator to select one of the preset steering modes;

wherein the steering modes include first and second preset steering modes, the first preset steering mode being defined by greater translation of the actuator than the second preset steering mode through at least a portion of the range of steering command signal generator actuation; and wherein a response curve plotting actuator response to translation of at least one of the steering command signal generators for the second preset mode is nonlinear and diverges away from the corresponding response curve for the first preset mode for a first portion of steering command signal generator translation within the range and converges towards the corresponding response curve for the first preset configuration for a second portion of steering command signal generator translation within the range.

2. The trowel of claim 1, wherein the at least one rotor assembly includes a first rotor assembly and a second rotor assembly, and each of the first and second rotor assemblies includes a gearbox and an actuator that is energizable to tilt the gearbox, one of the gearboxes being tiltable fore and aft and side-to-side to steer the trowel left and right and forward and reverse, respectively, and the other gearbox being tiltable side-to-side to steer the trowel fore and aft.

3. The trowel of claim 1, wherein the steering command signal generator comprises at least one of a joystick and a lever, and wherein the selector comprises at least one of a push-button, a switch, and a dial.

4. The trowel of claim 3, wherein the steering command signal generator includes first and second joysticks electronically coupled to the first and second actuators.

5. The trowel of claim 1, wherein the steering modes additionally include a third preset steering mode having another preset association between movement of the manually manipulated steering command signal generator and the actuator that is different than the first and second preset associations.

6. The trowel of claim 1, wherein, in the second steering mode, the response curve for one of the actuators that effects side-to-side steering is of reduced average magnitude and slope through at least a portion of the range of steering command signal generator translation compared to the response curve for another of the actuators that effects fore and aft steering.

7. A power steered riding rotary trowel comprising:

a frame;

a first rotor assembly and a second rotor assembly;

left and right operator manipulated joysticks;

actuators configured to tilt the rotor assemblies in response to joystick translation;

a controller connected to the joysticks and the actuator, the controller having a memory storing a first preset configuration and a second preset configuration, wherein each preset configuration defines a respective steering mode reflecting a respective association between a range of translation of the joystick and a resulting range of the actuator actuation, wherein a response curve plotting actuator response to movement of at least one of the joysticks for the second preset configuration is nonlinear and diverges away from the corresponding response curve for the first present configuration for a first portion of joystick translation within the range and converges towards the corresponding response curve for the first present configuration for a second portion of joystick translation within the range; and a selector that is operated by the operator to select one of the steering modes.

8. The trowel of claim 7, wherein more than two steering modes are selectable using the selector.

9. The trowel of claim 7, further comprising an electronic user interface which is configured to permit a technician to communicate with the controller to set and/or adjust values of each association.

10. The trowel of claim 7, wherein operating the steering system in the first preset steering mode results in greater operation of the actuator than the second preset steering mode for an equal translation of the joystick.

11. The trowel of claim 7, wherein the selector is operable by a seated operator while the trowel is traveling and is located on or in the vicinity of the joystick.

12. The trowel of claim 7, wherein the first steering mode is one in which the actuators are relatively non-responsive to small and intermediate joystick strokes, resulting in relatively high resolution steering, and the second steering mode is one in which the actuators are relatively responsive to small and intermediate joystick strokes, resulting in relatively low resolution steering.

13. The trowel of claim 7, wherein, in the second steering mode, the response curve for one of the actuators that effects side-to-side steering is of reduced average magnitude and slope through at least a portion of the range of joystick translation compared to the response curve for another of the actuators that effects fore and aft steering.

14. A method of controlling operation of a power steered riding rotary trowel comprising:

operating at least one steering command signal generator to tilt at least portions of rotor assemblies of the trowel to steer the trowel; and selecting between a first preset steering mode and a second preset steering mode, each preset steering mode having a different association between a range of translation of the steering command signal generator and a resulting range of translation of the rotor assemblies, wherein a response curve plotting rotor assembly tilting in response to translation of the steering command signal generator for the second preset steering mode is nonlinear and diverges away from the corresponding response curve for the first present steering mode for a first portion of steering command signal generator movement within the range and converges toward the corresponding response curve for the first preset steering mode for a second, subsequent portion of the steering command signal generator movement within the range.

15. The method of claim 14, further comprising selecting between another preset steering mode.

16. The method of claim 14, further comprising setting at least one of the first and the second steering modes as a default made.

17. The method of claim 14, wherein the operating step comprises manipulating at least one joystick and the selecting step comprises operating a switch located on or in the vicinity of the joystick.

18. The method of claim 17, wherein the selecting step is performed while the trowel is traveling.

19. The method of claim 14, wherein the first steering mode is one in which the actuators are relatively non-responsive to small and intermediate steering command signal generator strokes, resulting in relatively high resolution steering, and the second steering mode is one in which the actuators are relatively responsive to small and intermediate steering command signal generator strokes, resulting in relatively low resolution steering.

20. The method of claim 14, wherein, in the second steering mode, the response curve for one of the actuators that effects side-to-side steering is of reduced average magnitude and slope through at least a portion of the range of steering command signal generator translation compared to the response curve for another of the actuators that effects fore and aft steering.

* * * * *